United States Patent [19]

Hanejko

[11] Patent Number: 4,499,048

[45] Date of Patent: Feb. 12, 1985

[54] METHOD OF CONSOLIDATING A METALLIC BODY

[75] Inventor: Francis G. Hanejko, Irvine, Calif.

[73] Assignee: Metal Alloys, Inc., Signal Hill, Calif.

[21] Appl. No.: 469,100

[22] Filed: Feb. 23, 1983

[51] Int. Cl.[3] ..... B22F 3/00

[52] U.S. Cl. ..... 419/49; 419/28

[58] Field of Search ..... 419/6, 8, 28, 29, 48, 419/49, 56, 66, 68; 264/56, 500, 503

[56] References Cited

U.S. PATENT DOCUMENTS

| | | | |
|---|---|---|---|
| 3,279,917 | 10/1966 | Ballard et al. | 419/56 |
| 3,284,195 | 11/1966 | Googin et al. | 419/56 |
| 3,413,393 | 11/1968 | Turk | 419/48 |
| 3,455,682 | 7/1969 | Barbaras | 419/49 |
| 3,469,976 | 9/1969 | Iler | 419/49 |
| 3,689,259 | 9/1972 | Haily | 419/49 |
| 3,939,241 | 2/1976 | Powell et al. | 419/49 |
| 4,431,449 | 2/1984 | Dillon et al. | 419/48 |

*Primary Examiner*—Benjamin R. Padgett
*Assistant Examiner*—T. J. Wallen
*Attorney, Agent, or Firm*—Spensley, Horn, Jubas & Lubitz

[57] ABSTRACT

A method of consolidating a metallic body is disclosed. The method comprises the steps of forming an article of manufacture from powdered metal; sintering the article of manufacture so as to increase the strength thereof; coating the article with a sacrificial layer of ceramic; providing a bed of heated, generally spheroidal ceramic particles; compacting the coated article of manufacture embedded in the heated bed under pressure to thereby consolidate the article into a dense, desired shape; and, removing said sacrificial coating such that the surface of the article remains substantially free of process-related imperfections.

10 Claims, 5 Drawing Figures

METHOD OF CONSOLIDATING A METALLIC BODY

BACKGROUND OF THE INVENTION

1. Field of the Invention

This invention relates to the field of consolidating bodies, and more specifically, to an improved method which enables metallic bodies to be made with minimal distortion.

2. Prior Art

Methodology associated with producing high density metallic objects by consolidation is recognized in the prior art. Exemplars of prior art references which discuss such methodology are U.S. Pat. Nos. 3,356,496 and 3,689,259. Prior to discussing these references, a brief discussion will be set forth which illustrates the two primary methodologies currently used to densify either loose powder or a prepressed metal powder compact. These two techniques are generally referred to as Hot Isostatic Pressing and Powder Forging. The Hot Isostatic Pressing ("HIP") process comprises placing loose metal powder or a prepressed compact into a metal can or mold and subsequently evacuating the atmosphere from the can, sealing the can to prevent any gases from reentering, and placing the can in a suitable pressure vessel. The vessel has internal heating elements to raise the temperature of the powder material to a suitable consolidation temperature. Internal temperatures of 1000° C. to 2100° C. are typically used depending upon the material being processed. Coincident with the increase in the internal temperature of the HIP vessel, the internal pressure is slowly increased and maintained at from 15,000 to about 30,000 psi again depending upon the material being processed. Under the combined effects of temperature and isostatic pressure, the powder is densified to the theoretical bulk density of the material.

A HIP vessel can accept more than one can during a given cycle and thus there is the ability to densify multiple powdered metal articles per cycle. In addition, by the use of isostatic pressure, the densification is more or less uniform throughout the HIPed article. By the use of suitable can design, it is possible to form undercuts for transverse holes or slots in the densified article. However, the cycle time of the charge is slow, often requiring 8 hours or longer for a single cycle. Further, at the completion of the cycle, the cans surrounding the powdered metal article have to be either machined off or chemically removed.

The second common method of densifying powdered metal is a technique referred to as Powder Forging ("PF"). The Powder Forging process comprises the steps of:

(a) cold compacting loose metal powder at room temperature in a closed die at pressures in the range of 10–50 TSI into a suitable geometry (often referred to as a "preform") for subsequent forging. At this stage, the preform is friable and may contain 20–30 percent porosity and its strength is derived from the mechanical interlocking of the powdered particles.

(b) sintering the preform (i.e. subjecting the preform to an elevated temperature at atmospheric pressure) under a protective atmosphere. Sintering causes solid state "welding" of the mechanically interlocked powdered particles.

(c) reheating the preform to a suitable forging temperature (depending upon the alloy). Alternately this reheating step may be incorporated into the sintering step.

(d) forging the preform in a closed die into the final shape. The die is typically maintained at a temperature of about 300° F. to 600° F.

The forging step eliminates the porosity inherent from the preforming and gives the final shape to the PF part.

Advantages of Powder Forging include: speed of operation (up to 1000 pieces per hour), ability to produce a net shape, mechanical properties substantially equivalent to conventionally forged products and increased material utilization. However, there are number of disadvantages including nonuniformity of density because of chilling of the preform when in contact with the relatively cold die, and the inability to form undercuts which can be done in HIP.

Now referring back to the patents mentioned above, such references disclose what appears to be a combination of isothermal and isostatic conditions of HIP and HIP's ability to form undercuts, with the high speed, low cost continuous production normally associated with Powder Forging. In the '496 patent, the use of a cast ceramic outer container is taught as the primary heat barrier. In addition, this cast ceramic outer container when deformed causes nearly uniform distribution of pressure on the powdered material.

In the '259 patent the use of granular refractory materials is taught. This reference is intended as an improvement over the earlier '496 patent in relation to faster heating of the grain and faster heating of the prepressed part.

While the '496 and '259 patents may represent advances in the art, significant problems remain with respect to the use of a bed of ceramic into which a preform is placed prior to consolidation. More specifically it has been found that the use of crushed and ground ceramics or carbides results in a significantly nonuniform pressure distribution from the top of the charge (the surface against the moving press member) to the bottom of the charge (the surface against the fixed press bed). This non-uniformity of pressure distribution is readily demonstrated when consolidating a prepressed right circular cylinder of a powdered material. After consolidation in a bed of crushed and ground or fused ceramic material to nearly 100% of bulk density, it was determined that the surface of the prepressed cylinder nearest the moving press ram was smaller in diameter than the surface nearest the fixed bed. Sectioning the consolidated cylinder along a diameter and examining the sectioned surface, indicated that it had the shape of a trapezoid. The above phenomena was observed in all consolidated articles when a crushed and ground or fused granular ceramic matrix was employed as the consolidation media.

The solution to the problems associated with such distortion and lack of dimentional stability in shape has proved ellusive, especially when the solution must also be applicable to mass production. It has recently been determined that the use of generally spheroidal ceramics particles, especially when coated with a thermally stable lubricant, overcame most of the distortion problems. However, the use of a ceramic bed will inherently lead to embedding of the ceramic particles into the surface of the preform. This creates surface imperfections which can adversely affect strength, functionality and aesthetic appearance. The present invention provides a solution to this problem.

SUMMARY OF THE INVENTION

The present invention is directed to a method of consolidating metallic bodies comprising the steps of:

(a) forming an article of manufacture from powdered metal. Preferably, such forming step is done by compaction such as is well known in the art;

(b) sintering the article of manufacture so as to increase the strength thereof;

(c) coating the article of manufacture with a sacrificial, non-reactive ceramic coating;

(d) In the next step a hot bed of generally spheroidal ceramic particles is provided into which the coated article of manufacture is embedded. This bed, preferably of alumuna ($Al_2O_3$), is made by initially heating the refractory particles in a fluidized bed or by other equivalent means. In addition, because there are often times when the sintered article of manufacture is cooled, the coated article may be subsequently reheated and placed in the hot bed. Additional spheroidal ceramic particles are then added to cover the article. Alternating layers of hot particles and hot coated articles of manufacture are also within the scope of this invention;

(e) compacting the coated article of manufacture in the hot bed under high pressure to thereby consolidate the coated article into a dense shape of the desired configuration; and (f) removing the sacrificial coating.

By the use of the methodology of the present invention, structural articles of manufacture can be made having minimal distortion and improved surface finishes. To further decrease the amount of distortion, the spheroidal ceramic particles used for the bed can be coated with a thermally stable, non-reactive coating such as graphite or mica.

The novel features which are believed to be characteristic of this invention, both as to its organization and method of operation, together with further objectives and advantages thereof will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

A BRIEF DESCRIPTION OF THE DRAWINGS

BRIEF DETAILED DESCRIPTION OF THE INVENTION

Figure 1:
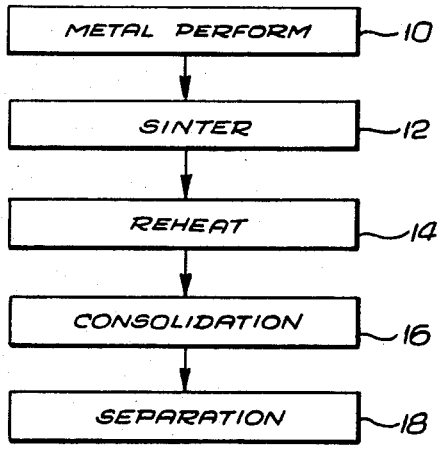
FIG. 1 is a flow diagram showing the method steps of the present invention.

Referring first to FIG. 1, there is shown a flow diagram illustrating the method steps of the present invention. As can be seen from numeral 10, initially a metal article of manufacture or preform is made, for example, in the shape of a wrench. While the preferred embodiment contemplates the use of a metal preform made of powdered steel particles, other metals are also within the scope of the invention. A preform typically is about 85 percent of theoretically density. After the powder has been made into a preformed shape, it is subsequently sintered in order to increase the strength. In the preferred embodiment, the sintering of the metal (steel) preform requires temperatures in the range of about 2,000° to 2,300° F. for a time of about 2–30 minutes in a protective atmosphere. In the preferred embodiment such protective, non-oxidizing inert atmosphere is nitrogen-based. Subsequent to sintering, illustrated at 12, the sintered preforms are usually permitted to cool and are then coated as indicated at 14. On the preferred embodiment the coating is made of alumina, zirconium oxide, chrome oxide, or silica, which all have a hardness greater than the metal preform at the consolidation temperature. Other similar, hard, generally inert protectively removable coatings are also within the scope of the invention.

The coating is applied by plasma spraying, dipping, or painting, all such coating methodologies being well known in the art such that a continuous coating of about 0.005 to 0.030 in. is achieved. Depending upon the coating method used, it may be necessary to reheat the preform. Further, reheating to about 1950° F. in a protective atmosphere may be necessary prior to consolidation.

The consolidation process, illustrated at 16, takes place after the hot coated preform has been placed in a bed of ceramic particles as hereinbelow discussed in greater detail. In order to generate the desired high quantity of production, alternating layers of hot ceramic particles and hot coated preforms can be used. Consolidation takes place by subjecting the embedded coated preform to high temperature and pressure. For metal (steel) objects, temperatures in the range of about 2,000° F. and uniaxial pressures of about 40 TSI are used. Compaction at pressures of 10–60 tons depending on the material are also within the scope of the present invention. The coated preform has now been densified and can be separated, as noted at 18, where the ceramic particles separate readily from the preform and can be recycled. Further, because there is a protective coating on the preform, any embedding which might take place, does so in the protective coating. This coating is then removed thereby enabling the surface of the preform to remain substantially smooth and relatively free of processing-related imperfections. In the preferred embodiment, the protective ceramic coating is sand blasted off, although other means of removal such as chemical or water baths are also within the scope of this invention.

The benefits of using a coated preform can be combined with the advantageous results associated with the use of spheroidal ceramic particles or coated spheroidal ceramic particles as the bed. In the preferred embodiment, alumina is used and is coated with 1 to 2% by weight carbon in the form of graphite. Other spheroidal ceramic particles such as silica, zirconia, silicon carbide and boron nitride can also be used as the bed, and other thermally stable, non-reactive lubricants can be used such as molybdenum disulfide, and mica.

The choice of the ceramic material for the bed is also important for another reason in the consolidation process. If a particle is chosen which shows a tendency for sintering at the consolidation temperature, the pressure applied will be absorbed in both densifying the prepressed powder metal and densifying the media. For example, using silica at a consolidation temperature of approximately 2000° F. will require higher pressure to achieve densification when compared with using alumina at the same temperature. The use of zirconium oxide, silica, or mullite at temperatures above 1700° F. results in higher densification pressures because these ceramics themselves begin to sinter at temperatures above 1700° F.

To overcome the sintering and resulting higher pressures required, with some ceramic materials spheriodal alumina is the preferred consolidation media up to temperatures of 2200° F. Further, spheroidal alumina possesses good flow characterics, heat transfer and a minimal amount of self-bonding during consolidation. An additional advantage of the spheroidal shape is the greatly reduced self bonding of the particles after consolidation. Preferrably, the spheroidal particles of the present invention have a size in the range of 100 to 140 mesh.

Figure 2:
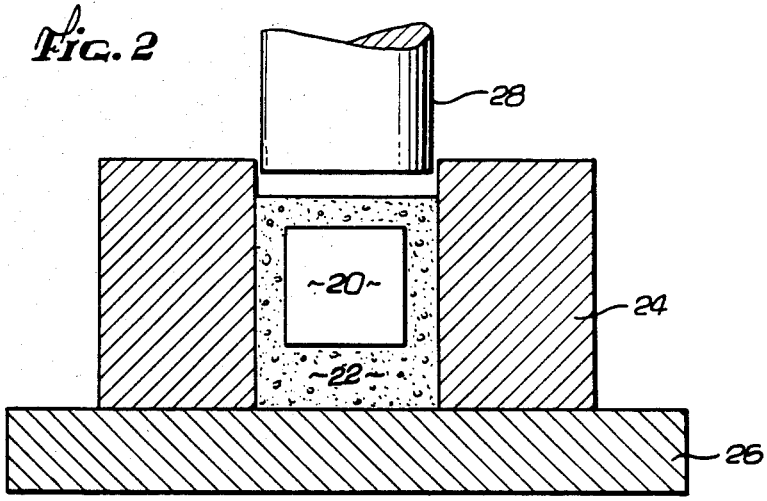
FIG. 2 is a cut-away plan view showing the consolidation step of the present invention.

Referring now to FIG. 2 the consolidation step is more completely illustrated. In the preferred embodiment, the preform 20 is initially coated with a discrete layer 21 of alumina. The coated preform is now completely embedded in a hot bed of generally spheroidal alumina particles 22 in a consolidation die 24. Press bed 26 forms a bottom of the bed, while hydraulic press ram 28 defines a top and is used to press down onto the particles 22 and coated preform 20.

The coated metal powder preform 20 is rapidly compressed under high uniaxial pressure by the action of ram 28 in die 24. Die 24 has no defined shape (such as the shape of a wrench), and there is negligible lateral flow of the preform 20. As a consequence, consolidation occurs almost exclusively in the direction of ram 28 travel. Any embedding of the particles 22 will take place in layer 21 thus protecting the surface of preform 20.

Figure 3:
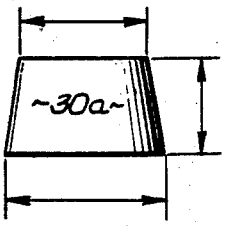
FIG. 3 is a plan view showing a previously coated consolidated article of manufacture which has been consolidated in a bed of alumina particles not of spheroidal shape.
Figure 4:
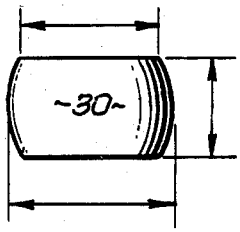
FIG. 4 is a plan view showing a previously coated consolidated article of manufacture which has been consolidated in a bed of spheroidal alumina particles.

The use of nonspheroidal particles produces nonuniform pressure distribution such that after consolidation, a plan view of a cylinder 30*a* sectioned along a diameter would have the shape of a trapezoid as illustrated in FIG. 3 and would approach 100% of full density. Referring now to FIG. 4, one can see that the same prepressed right circular cylinder 30 when consolidated in a matrix of spheroidal alumina particle has equal diameters at the top and bottom with a slightly larger diameter at the mid-height. Why the large diameter occurred at the mid-height is not known; however, the difference in diameter was so significantly reduced as to constitute a distinct improvement over the prior art.

Figure 5:
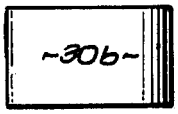
FIG. 5 is a plan view showing a previously coated consolidated article of manufacture which has been consolidated in a bed of spheroidal alumina particles coated with graphite.

However, to compensate for this distortion in the article associated with the use of the spheroidal alumina, further machining and/or redesigning of the preform is required. Referring now to FIG. 5, yet another right cyliner 30*b* is illustrated. In this embodiment, graphite has been coated onto the spheroidal alumina. As one can see, the cylinder 30*b* retained its original shape i.e. the diameter remained substantially uniform from top to bottom. Thus, by the use of a lubricant, the need for further machining and/or redesigning of the preform is substantially eliminated.

As discussed above, the problem of surface imperfection remains. This is solved by the use of coating 21. In this manner, articles of manufacture having smooth surfaces, substantially free of process-related imperfection are produced.

While the present invention has been described, it will be apparent to those skilled in the art that other embodiments are clearly within the scope of the present invention. For example, preform 20 can be a wrench or other similar object. This invention, therefore, is not intended to be limited to the particular embodiments herein disclosed.

I claim:

1. A method of consolidating a metallic body comprising the steps of:

(a) forming an article of manufacture from powdered metal;

(b) sintering said article of manufacture so as to increase the strength thereof;

(c) coating said article of manufacture with a sacrificial cermic coating;

(d) providing a bed of heated, generally spheroidal ceramic particles;

(e) compacting said coated article of manufacture in said heated bed of generally spheroidal ceramic particles under high pressure to thereby consolidate said coated article of manufacture into a dense, desired shape; and (f) removing said sacrificial ceramic coating such that the surface of said article of manufacture remains substantially free of process-related inperfections.

2. A method of consolidating a metallic body according to claim 1 wherein said generally spheroidal ceramic particles are alumina.

3. A method of consolidating a metallic body according to claims 1 or 2 where said alumina particles are coated with a thermally stable, generally non-reactive lubricant.

4. A method of consolidating a metallic body according to claim 3 wherein said lubricant is graphite.

5. A method of consolidating a metallic body according to claim 1 wherein said sacrificial ceramic coating is selected from the group consisting of alumina, silica, chrome oxide and zirconium oxide.

6. A method of consolidating a metallic body comprising the steps of:

(a) forming an article of manufacture from powdered metal;

(b) sintering said article of manufacture so as to increase the strength thereof;

(c) coating said article of manufacture with a sacrificial ceramic coating;

(d) providing a bed of heated, generally spheroidal ceramic particles which have been coated with a thermally stable, generally non-reactive lubricant;

(e) heating said coated article of manufacture to a predetermined temperature;

(f) compacting said coating article of manufacture in said heated bed of generally spheroidal coated ceramic particles under high pressure to thereby consolidate said article of manufacture into a dense, desired shape; and (g) removing said sacrificial ceramic coating such that the surface of said article of manufacture remains substantially free of process-related inperfections.

7. A method of consolidating a metallic body according to claim 6 where said generally spheroidal ceramic particles are alumina.

8. A method of consolidating a metallic body according to claim 6 wherein said sacrificial ceramic coating is selected from the group consisting of alumina, silica, chrome oxide and zirconium oxide.

9. A method of consolidating a metallic body according to claim 7 where said generally spheroidal alumina particles have a size in the range of about 100 to 140 mesh.

10. A method of consolidating a metallic body according to claim 8 wherein said lubricant is graphite.

* * * * *